US009823607B2

(12) United States Patent
Kuroda et al.

(10) Patent No.: US 9,823,607 B2
(45) Date of Patent: Nov. 21, 2017

(54) FIXING DEVICE

(71) Applicant: CANON KABUSHIKI KAISHA, Tokyo (JP)

(72) Inventors: Akira Kuroda, Numazu (JP); Hiroshi Mano, Numazu (JP); Aoji Isono, Naka-gun (JP); Minoru Hayasaki, Mishima (JP); Yuki Nishizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/212,072

(22) Filed: Jul. 15, 2016

(65) Prior Publication Data

US 2016/0327892 A1 Nov. 10, 2016

Related U.S. Application Data

(63) Continuation of application No. 14/568,024, filed on Dec. 11, 2014, now Pat. No. 9,417,573.

(30) Foreign Application Priority Data

Dec. 18, 2013 (JP) ..... 2013-261517

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053
See application file for complete search history.

(56) References Cited

U.S. PATENT DOCUMENTS 5,822,669 A * 10/1998 Okabayashi ..... H05B 6/145 219/619
6,021,303 A * 2/2000 Terada ..... G03G 15/2053 399/328
9,176,441 B2 * 11/2015 Yonekubo ..... G03G 15/2053
(Continued)

FOREIGN PATENT DOCUMENTS

JP 09-185273 A 7/1997
JP 09-306655 A 11/1997
(Continued)

*Primary Examiner* — Carla Therrien
(74) *Attorney, Agent, or Firm* — Canon USA, Inc. I.P. Division

(57) ABSTRACT

Disclosed is a cylindrical rotary member including a conductive layer; a coil disposed inside the rotary member, the coil including a helical portion having a helical axis that is substantially parallel to a generatrix direction of the rotary member, the coil forming an alternating magnetic field to generate heat in the conductive layer by electromagnetic induction; a core disposed inside the helical portion, the core inducing a line of magnetic force of the alternating magnetic field; a roller coming in contact with an outer surface of the rotary member to form a fixing nip portion; and a metal stay disposed inside the rotary member, in which an image on a recording material is fixed to the recording material by being heated at the fixing nip portion and the stay is disposed outside the coil and has a shape that does not form an electrical loop around the coil.

8 Claims, 6 Drawing Sheets

(56) References Cited

U.S. PATENT DOCUMENTS

2004/0037597 A1* 2/2004 Haseba ..... G03G 15/2053 399/328
2005/0063744 A1* 3/2005 Kwak ..... G03G 15/2053 399/328
2005/0147435 A1* 7/2005 Kwak ..... G03G 15/2053 399/329
2012/0008971 A1* 1/2012 Lee ..... G03G 15/2064 399/69
2012/0275833 A1* 11/2012 Ishida ..... G03G 15/2053 399/329
2013/0209147 A1* 8/2013 Ogawa ..... G03G 15/2028 399/329
2015/0132035 A1* 5/2015 Nishizawa ..... H05B 6/365 399/329
2015/0168880 A1* 6/2015 Jota ..... G03G 15/2053 399/333
2015/0168881 A1* 6/2015 Obata ..... G03G 15/206 399/329
2015/0168889 A1* 6/2015 Kita ..... G03G 15/2039 399/33
2015/0168893 A1* 6/2015 Yonekubo ..... G03G 15/2053 399/329
2015/0168894 A1* 6/2015 Isono ..... G03G 15/2053 399/329
2015/0168895 A1* 6/2015 Nishizawa ..... G03G 15/2053 399/330
2015/0168896 A1* 6/2015 Yonekubo ..... G03G 15/2053 399/329
2016/0370743 A1* 12/2016 Nishimura ..... G03G 15/2053

FOREIGN PATENT DOCUMENTS

JP 10-123861 A 5/1998
JP 2001051531 A * 2/2001
JP 2011154232 A * 8/2011

* cited by examiner

FIXING DEVICE

CROSS-REFERENCE TO RELATED APPLICATIONS

This application is a continuation, and claims the benefit, of U.S. patent application Ser. No. 14/568,024, presently pending and filed on Dec. 11, 2014, and claims the benefit of, and priority to, Japanese Patent Application No. 2013-261517, filed Dec. 18, 2013, which applications are hereby incorporated by reference herein in their entireties.

BACKGROUND

Field of the Invention

The present disclosure relates to a fixing device used in an electrophotographic image forming apparatus.

Description of the Related Art

In recent years, a fixing device that uses a cylindrical belt is increasing with the aim to suppress the heat capacity of the fixing device. Furthermore, there is a device that adopts an electromagnetic induction heating method in order to increase the rate of temperature rise of the belt. Japanese Patent Laid-Open No. 2011-154232 describes a fixing device that uses a belt and that adopts an electromagnetic induction heating method.

A fixing device that uses a belt needs to dispose a stay inside the belt in order to form a fixing nip portion. Since the stay needs to be rigid, the stay is typically made of metal.

However, magnetic flux concentrates inside a spiral coil. As is the case of Japanese Patent Laid-Open No. 2011-154232, when a stay is disposed inside a coil, eddy current occurs in the stay due to magnetic flux concentrating inside the coil, disadvantageously resulting in generation of heat in the stay.

Such an issue is not limited to fixing devices that use a belt and the same issue can be encountered even in a device that uses, rather than a belt, a roller with high rigidity, when a stay is disposed inside a roller.

SUMMARY

The present disclosure provides a fixing device that adopts an electromagnetic induction heating method and that is capable of suppressing generation of heat in a metal stay disposed inside a rotary member.

The fixing device includes:

a cylindrical rotary member including a conductive layer;

a coil that is disposed inside the rotary member, the coil including a helical portion having a helical axis that is substantially parallel to a generatrix direction of the rotary member, the coil being configured to form an alternating magnetic field to generate heat in the conductive layer by electromagnetic induction;

a core that is disposed inside the helical portion, the core configured to guide a line of magnetic force of the alternating magnetic field;

a roller that comes in contact with an outer surface of the rotary member so as to form a fixing nip portion between the roller and the rotary member; and a metal stay that is disposed inside the rotary member, in which an image on a recording material is fixed to the recording material by being heated at the fixing nip portion, and in which the stay is disposed outside the coil and has a shape that does not form an electrical loop around the coil.

Further features of the present invention will become apparent from the following description of exemplary embodiments with reference to the attached drawings.

DESCRIPTION OF THE EMBODIMENTS

First Exemplary Embodiment

Figure 1:
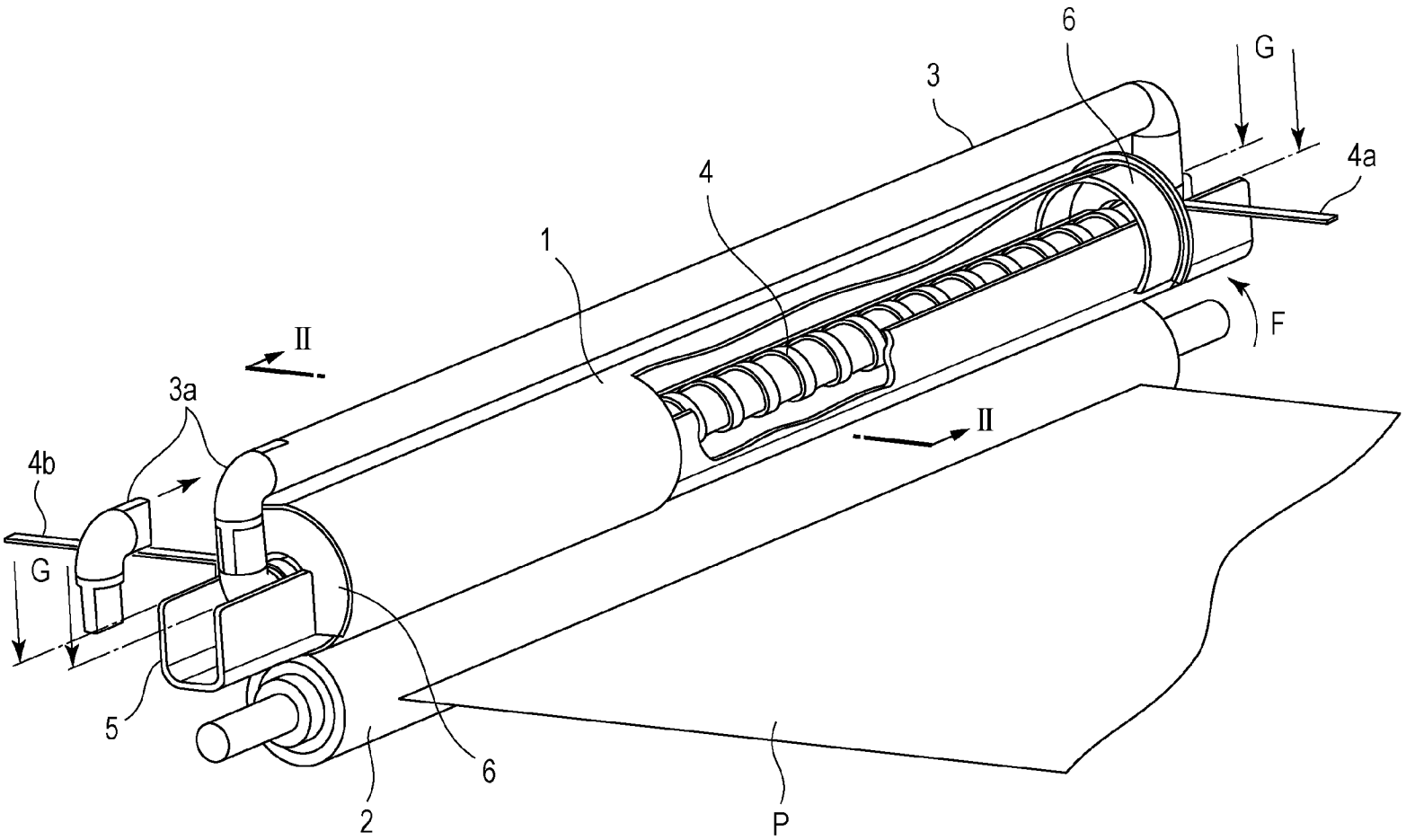
FIG. 1 is a perspective view of a fixing device of a first exemplary embodiment.
Figure 2:
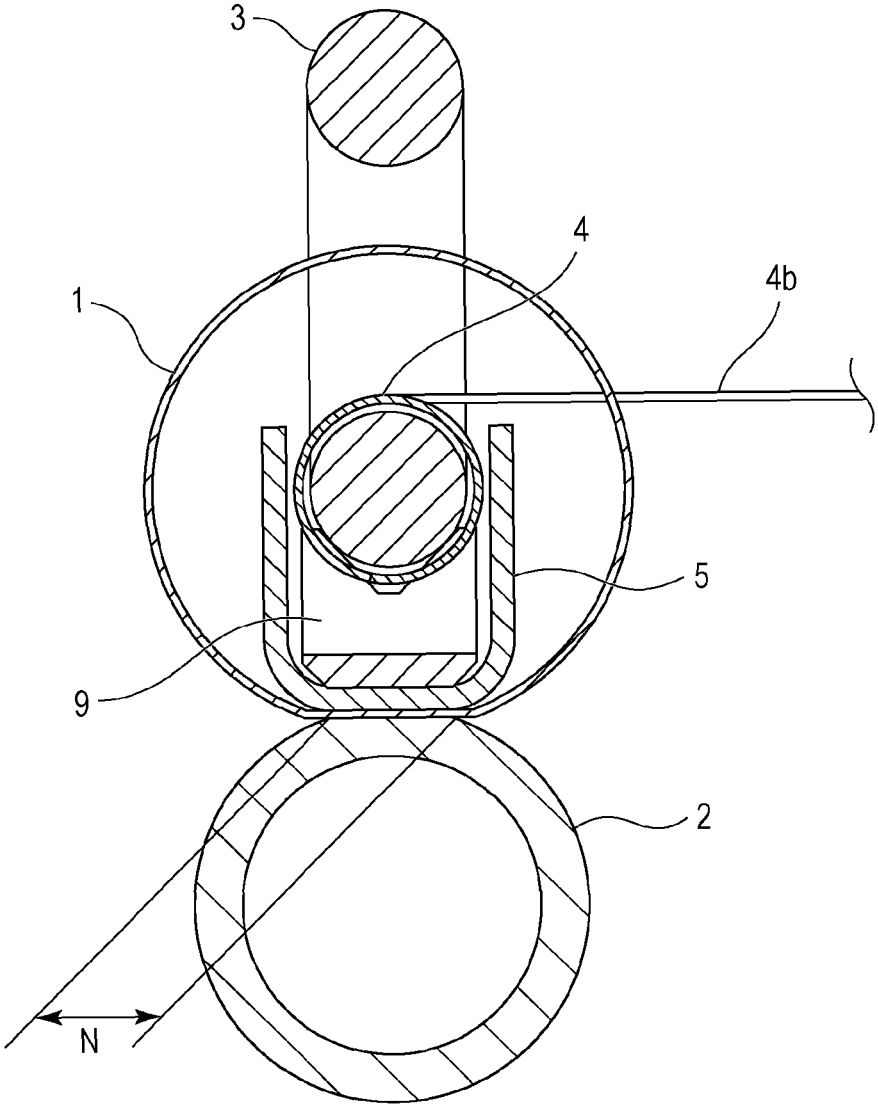
FIG. 2 is a cross-sectional view of the fixing device of the first exemplary embodiment.
Figure 3:
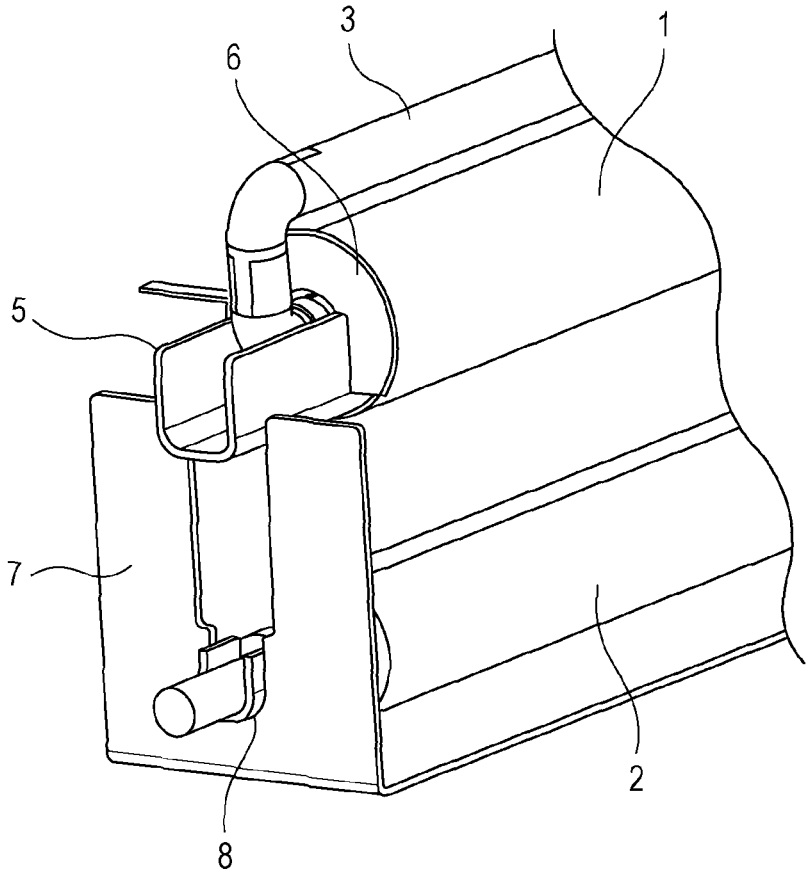
FIG. 3 is a diagram illustrating a configuration of components at an end portion of the fixing device of the first exemplary embodiment.

FIG. 1 is a perspective view of a fixing device of a first exemplary embodiment, FIG. 2 is a cross-sectional view taken along line II-II of FIG. 1, and FIG. 3 is a perspective view of an end portion of the fixing device in the longitudinal direction. Reference numeral 1 designates a cylindrical fixing belt (a rotary member) including a conductive layer, reference numeral 2 designates a pressure roller that comes in contact with an outer surface of the belt 1 to form a fixing nip portion between itself and the belt 1. Reference numeral 4 designates a coil that is disposed inside the belt 1, the coil 4 including a helical portion of which a helical axis is substantially parallel to a generatrix direction of the belt 1. The coil 4 forms an alternating magnetic field that generates heat in the conductive layer of the belt 1 by electromagnetic induction. Reference numeral 3 designates a core that is disposed inside the helical portion of the coil 4 and that guides the line of magnetic force of the alternating magnetic field, and reference numeral 5 designates a metal stay that is disposed inside the belt 1.

The fixing belt 1 includes the conductive layer that is formed of a metal material, such as Ni, Steel Use Stainless (SUS), or the like, with a thickness of 20 μm to 50 μm, an elastic layer that is formed around the conductive layer with a material such as silicone rubber, and a release layer that is formed around the elastic layer with a material such as fluorocarbon polymer or the like. The two edge portions of the belt 1 are each provided with a flange 6 opposing an edge surface of the belt 1 to restrict the belt 1 from being laterally shifted towards the generatrix direction. Each flange 6 also includes a portion that opposes an inner surface of the belt 1, which has a function of guiding the rotation of the belt 1. Each flange 6 is relatively positioned with respect to the stay 5 and is fixed to the stay 5.

The pressure roller 2 is a member in which the elastic layer formed of a material such as silicone rubber and the release layer formed of a material such as fluorocarbon polymer are laminated around a ϕ 14 mm core metal formed of aluminum or iron. The pressure roller 2 is rotatably supported by a frame 7 of the fixing device through a bearing 8 and is driven in a direction of arrow F illustrated in FIG. 1 with a motor (not shown) provided in an image forming apparatus body.

The magnetic core 3 is a ferromagnetic body that is composed of, for example, an oxide or an alloy with high permeability such as a sintered ferrite, a ferrite resin, an amorphous alloy, or a permalloy. Furthermore, the magnetic core 3 can be configured to have the largest cross-sectional area allowing the magnetic core 3 to be housed inside the fixing belt 1. The shape of the magnetic core 3 is not limited to a cylindrical shape and a polygonal columnar shape, for example, may be chosen. The magnetic core 3 of the present embodiment includes a portion that is disposed inside the fixing belt 1, a portion that is disposed outside the fixing belt 1, and intermediate portions (intermedial cores 3*a*) connecting the above portions to each other. Accordingly, the core 3 forms a closed magnetic circuit that protrudes out from one edge of the belt 1, extends through the outside of the belt 1, and returns into the belt 1 again through the other edge of the belt 1. The magnetic core 3 is held by a core holding member 9. The core holding member 9 is held by a stay 5 described later.

The energizing coil 4 is a litz wire or the like in which fine wires are twisted together, for example. The energizing coil 4 forms a helical portion by being wound around the magnetic core 3, which is inserted into the fixing belt 1 in the rotation axial direction of the fixing belt 1, in a direction intersecting the axis of rotation of the fixing belt 1 at predetermined pitches. Note that an insulation member (not shown), such as a heat resistant resin, is interposed between the magnetic core 3 and the energizing coil 4.

The stay 5 is formed by bending a plate made of metal, SUS, aluminum, or the like having a plate thickness of 1 mm to 2 mm. The stay 5 according to the present embodiment is disposed so as to surround the energizing coil 4, has a substantially U-shaped cross-section, and is electrically insulated in a circumferential direction of the fixing belt 1. In other words, as illustrated in FIGS. 1 to 3, the stay 5 is disposed outside the coil 4 and is shaped so as not to form a loop around the coil 4. Furthermore, a sliding layer having electrically insulating and heat resistance properties formed of, for example, PFA or polyimide is provided on a surface facing a fixing nip portion N. As illustrated in FIG. 3, the stay 5 is fitted into opening portions provided in the frame 7 and is mounted in the frame 7.

Configured as above, a pressure of about 196 N is applied to the two ends of the stay 5 in a direction indicated by arrows G in FIG. 1. Accordingly, the outer peripheral surfaces of the fixing belt 1 and the pressure roller 2 are made to be in pressure contact with each other and the fixing nip portion N on which a pressure of about 0.1 MPa uniformly acts is formed. As aforementioned, when the pressure roller 2 is driven in the direction indicated by the arrow F in FIG. 1, the fixing belt 1 is rotated in a driven manner with the pressure roller 2 by frictional force between the fixing belt 1 and the outer peripheral surface of the pressure roller 2 in the fixing nip portion N.

High-frequency current is supplied from a high frequency power source (not shown) to coil terminals 4*a* and 4*b* provided at the two ends of the energizing coil 4. Accordingly, an alternating flux is generated. Since the alternating flux concentrates in the magnetic core 3 having a high permeability, electric current is induced to a metal base layer provided in the fixing belt 1 so as to form a magnetic flux that cancels out the alternating flux. The induced current flows in the rotating direction of the belt 1, and the specific electric resistance of the metal base layer and the induced current generates Joule heat in the fixing belt 1.

A recording material P on which an unfixed image has been formed is sent to the fixing nip portion N after the fixing belt 1 has reached a desired temperature. While being heated, the recording material P on which the unfixed image has been formed is pinched and conveyed by the fixing nip portion N so that the image is fixed to the recording material P.

As described above, the stay 5 is disposed not inside the coil 4 through which most of the magnetic flux (a main magnetic flux) is guided but is disposed outside the coil 4 and is formed in a shape that does not form an electrical loop around the coil 4 (a shape with a U-shaped section in the present exemplary embodiment). Since the stay 5 is disposed outside the coil 4, the main magnetic flux that is trapped in the core 3 does not pass through the stay 5. Furthermore, although the electric current that is induced so as to form a magnetic flux that cancels out the alternating flux occurs in the rotating direction of the belt 1, since the stay 5 is not formed in a loop shape, no induced current flowing in a direction same as the rotating direction of the belt 1 occurs. Since the above conditions are satisfied, even if the stay 5 is a magnetic metal, electric current that is induced to the stay 5 can be suppressed and generation of heat of the stay 5 can be suppressed.

Since the configuration suppresses generation of heat of the stay 5, the degree of freedom of design of the plate thickness and the size of the stay 5 is increased. Accordingly, a stay that has a rigidity needed to form a desired fixing nip portion can be used. Furthermore, since the stay 5 is disposed so as to surround the coil 4, the diameter of the belt 1 can be reduced and the heating efficiency of the fixing device can be improved.

Second Exemplary Embodiment

Figure 4:
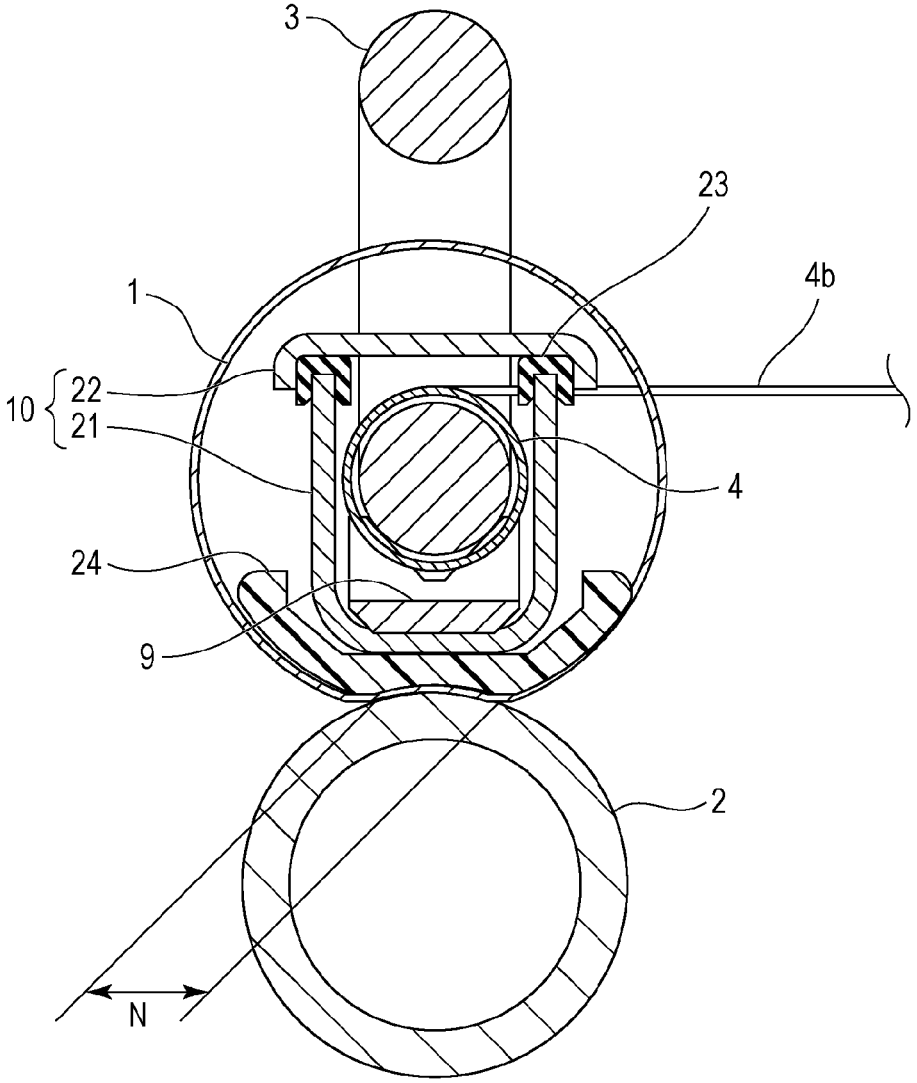
FIG. 4 is a cross-sectional view of a fixing device of a second exemplary embodiment.

A cross-sectional view of a fixing device of a second exemplary embodiment is illustrated in FIG. 4. Note that components similar to those of the first exemplary embodiment are denoted with the same reference numerals as those of the first exemplary embodiment and the description thereof are omitted herein.

A stay 10 of the present exemplary embodiment includes a stay 21 and a stay 22. Spacers (insulation members) 23 made of an electrically insulating and heat resistant resin, such as liquid crystal polymer (LCP) or polyphenylene sulfide (PPS), are interposed between the stay 21 and the stay 22. The stay 21 and the stay 22 are electrically insulated with respect to each other with the spacers 23. That is, the stay 10 includes a plurality of metal members 21 and 22 that are electrically insulated with respect to each other with the spacers 23. In other words, the stay 10 includes the plurality of metal members 21 and 22 that are insulated with respect to each other at at least a portion of the metal members 21 and 22 so as to prevent an electrical loop from being formed. Accordingly, induction of electric current to the stay 10 in the rotating direction of the belt 1 can be prevented while increasing the geometrical moment of inertia of the stay 10 so that the flexural rigidity of the stay 10 is improved.

A slide plate 24 is provided between the stay 10 and the inner surface of the fixing belt 1. The slide plate 24 is formed of a heat resistant resin, such as LCP or PPS, and a release layer formed of, for example, PFA or PTFE is provided on a surface that slides against the inner surface of the fixing belt 1. Furthermore, the shape of the fixing nip portion N is formed in a convex manner with respect to the stay 10 and the sliding surface is formed in a concave manner with respect to the stay 10.

As described above, since the stay 10 can include a plurality of components having an insulation member therebetween, the degree of freedom of the shape of the stay 10 can be increased and a stay that has a desired flexural rigidity can be used. Furthermore, since the shape of the fixing nip portion N is formed in a convex manner with respect to the stay 10, a recording material that has passed through the fixing nip portion N is discharged along the convexity so as to be oriented towards the pressure roller 2 side. In other words, separation of the recording material from the fixing belt 1 is facilitated and winding jam and the like of the fixing belt 1 due to the viscosity of a melt toner are reduced.

Third Exemplary Embodiment

Figure 5:
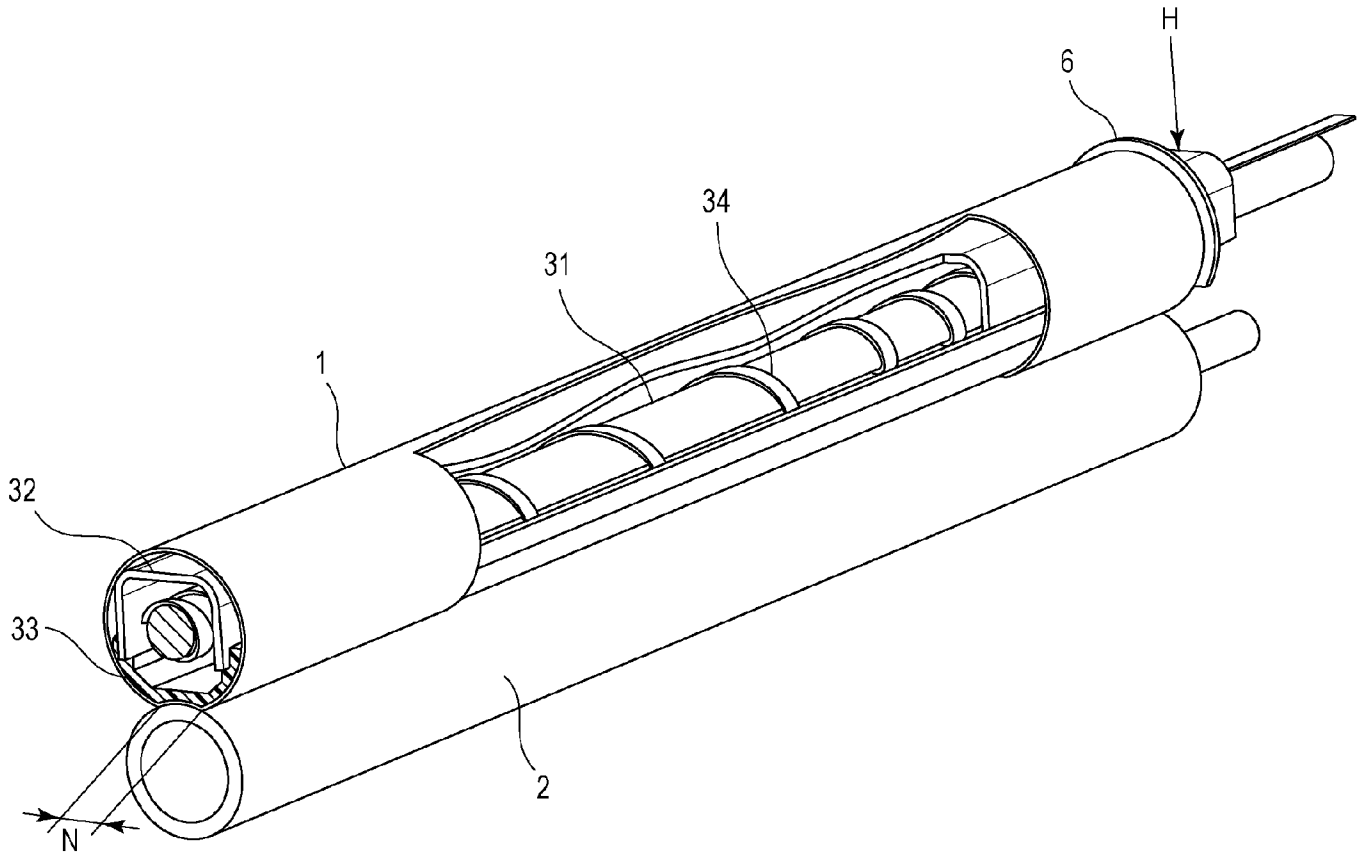
FIG. 5 is a perspective view of a fixing device of a third exemplary embodiment.
Figure 6:
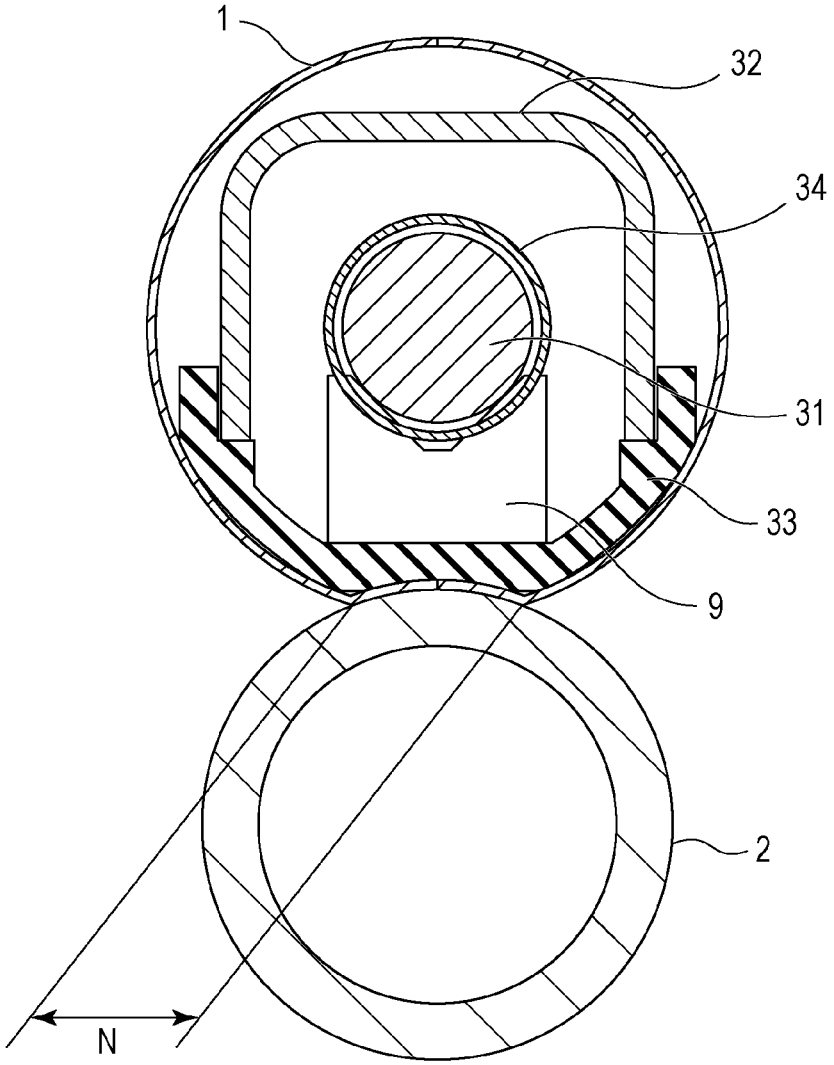
FIG. 6 is a cross-sectional view of the fixing device of the third exemplary embodiment.

FIG. 5 is a perspective view of a fixing device of a third exemplary embodiment and FIG. 6 is a cross-sectional view. Note that components similar to those of the first exemplary embodiment are denoted with the same reference numerals as those of the first exemplary embodiment and the description thereof are omitted herein.

Reference numeral 31 is a rod-shaped magnetic core that is inserted into the fixing belt 1, and reference numeral 32 is a metal stay, a section of which is substantially U-shaped, open to the fixing nip portion N side. The stay 32 receives pressure in the H direction of FIG. 5 and presses a sliding member 33 that is made of heat resistance resin and that has an electrically insulating property towards the pressure roller 2 side. The sliding member 33 forms the fixing nip portion N together with the roller 2 with the belt 1 in between. A core 31 has ends and protrudes out from both edges of the belt 1. Reference numeral 34 is a coil that is wound around the core 31. The present exemplary embodiment illustrates an open magnetic circuit configuration that uses the rod-shaped core 31. The core 31 is held by the core holding member 9, and the core holding member 9 is held by the sliding member 33. In the present exemplary embodiment also, the stay 32 is disposed outside the coil 34 and is formed so as not to form an electrical loop around the coil 34 with the sliding member 33 having an electrically insulating property. Furthermore, the stay 32 and the sliding member 33 surround the coil 34.

Generally, the alternating flux guided to the magnetic core 31 is guided thereto due to the difference in magnetic permeability between the magnetic core 31 and air and is known to not easily radiate from the end portions of the magnetic core 31. Accordingly, in the end portions of the magnetic core 31 in the longitudinal direction, the magnetic flux that is radiated in the radius direction of the fixing belt 1 increases and the magnetic flux that is radiated in the rotation axial direction of the fixing belt 1 decreases. As a result, the heat generation amount in the edge portions of the fixing belt 1 decreases. In the present exemplary embodiment, the length of the rod-shaped magnetic core 31 is sufficiently longer than that of the fixing belt 1 such that each of the end portions of the rod-shaped magnetic core 31 protrudes out by 20 to 50 mm from the corresponding edge portion of the fixing belt 1. Furthermore, the winding pitch of the energizing coil 34 is made denser as the energizing coil 34 becomes closer to the end portions of the magnetic core 31 so as to increase the magnetomotive force at the end portions of the magnetic core 31 and to prevent decrease in the heat generation amount of the fixing belt 1 described above.

In addition to obtaining the effects similar to those of the first and second exemplary embodiments, by using a rod-shaped magnetic core, the present exemplary embodiment can obtain effects such as simplification in the configuration of the fixing device, reduction in the manufacturing cost required to assemble the fixing device, and further reduction in the size of the fixing device.

The three exemplary embodiments described above relate to fixing devices that use a belt; however, the present invention can be applied to a fixing device that includes a roller (rotary member) that has no flexibility and a metal stay disposed inside the roller and that forms a fixing nip portion by applying pressure to the stay.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device, comprising:

a cylindrical rotary member including a conductive layer;

a coil that is disposed inside the rotary member, the coil including a helical portion of which a helical axis is substantially parallel to a generatrix direction of the rotary member, the coil being configured to form an alternating magnetic field to generate heat in the conductive layer by electromagnetic induction;

a core disposed inside the helical portion, the core configured to guide a line of magnetic force of the alternating magnetic field;

a roller that comes in contact with an outer surface of the rotary member so as to form a fixing nip portion between the roller and the rotary member; and a metal stay that is disposed inside the rotary member, wherein an image on a recording material is fixed to the recording material by being heated at the fixing nip portion, wherein the metal stay is disposed outside the coil, and wherein the metal stay has two U-shaped metal members with openings facing each other and has an insulation material between the two U-shaped metal members.

2. The fixing device according to claim 1, further comprising a sliding member that has an electrically insulating property, the sliding member configured to form the fixing nip portion together with the roller through the rotary member.

3. The fixing device according to claim 1, wherein the core forms a closed magnetic circuit that protrudes out from one edge of the rotary member, extends through the outside of the rotary member, and returns into the rotary member again through another edge of the rotary member.

4. The fixing device according to claim 1, wherein the rotary member is a belt.

5. A fixing device, comprising:

a cylindrical rotary member including a conductive layer;

a coil that is disposed inside the rotary member, the coil including a helical portion of which a helical axis is substantially parallel to a generatrix direction of the rotary member, the coil being configured to form an alternating magnetic field to generate heat in the conductive layer by electromagnetic induction;

a core disposed inside the helical portion, the core configured to guide a line of magnetic force of the alternating magnetic field;

a roller that comes in contact with an outer surface of the rotary member so as to form a fixing nip portion between the roller and the rotary member; and a metal stay that is disposed inside the rotary member, wherein an image on a recording material is fixed to the recording material by being heated at the fixing nip portion, wherein a cross sectional shape of at least a first portion of the metal stay has a U-shape, wherein the metal stay is arranged such that an opening portion of the U-shape of the at least first portion faces away from the nip portion, wherein the metal stay is disposed outside the coil, wherein a core holding member for holding the core is disposed on an inside surface of the metal stay, and wherein the metal stay has two U-shaped metal members with openings facing each other and has an insulation material between the two U-shaped metal members.

6. The fixing device according to claim 5, further comprising:

a sliding member provided between the rotary member and the metal stay and configured to form the fixing nip portion together with the roller through the rotary member.

7. The fixing device according to claim 5, wherein the core forms a closed magnetic circuit that protrudes out from one edge of the rotary member, extends through the outside of the rotary member, and returns into the rotary member again through another edge of the rotary member.

8. The fixing device according to claim 5, wherein the rotary member is a belt.

* * * * *